US005692933A

United States Patent [19]

Bradley et al.

[11] Patent Number: 5,692,933

[45] Date of Patent: Dec. 2, 1997

[54] LOW PROFILE FLOTATION COLLAR

[75] Inventors: Gary F. Bradley, Hendersonville; William Barry Shope, Asheville, both of N.C.

[73] Assignee: Simula Inc., Phoenix, Ariz.

[21] Appl. No.: 527,700

[22] Filed: Sep. 14, 1995

[51] Int. Cl.[6] ..... B63C 9/08

[52] U.S. Cl. ..... 441/106; 441/124

[58] Field of Search ..... 441/88, 95, 97, 441/100, 105, 106, 117, 118, 124

[56] References Cited

U.S. PATENT DOCUMENTS

| | | | |
|---|---|---|---|
| 1,375,803 | 4/1921 | Souliotis . | |
| 1,385,581 | 7/1921 | Pallady . | |
| 2,210,809 | 8/1940 | Gray . | |
| 3,716,882 | 2/1973 | Middleton et al. | 441/95 |
| 3,771,183 | 11/1973 | Moran . | |
| 4,671,775 | 6/1987 | Hill . | |
| 4,865,573 | 9/1989 | Switlik et al. | 441/92 |
| 5,421,760 | 6/1995 | Blaga . | |

*Primary Examiner*—Stephen Avila
*Attorney, Agent, or Firm*—Crowell & Moring LLP

[57] ABSTRACT

A safety and life-preserving flotation collar intended for use by aircraft and shipboard personnel in an emergency that leaves the personnel in the water. The flotation collar has a fabric shell housing two automatically inflatable, independent, and symmetric flotation cells; two oral inflators and mechanical inflators mounted on the fabric shell; and a face shield stowed in the fabric shell. The flotation collar may be worn with an auxiliary belt or with a survival vest.

38 Claims, 10 Drawing Sheets

LOW PROFILE FLOTATION COLLAR

BACKGROUND

1. Field of the Invention

The present invention relates to personnel flotation devices, i.e., life preservers, and, more specifically, to flotation collars.

2. Background of the Invention

Military and federal regulations require the availability of life preservers on board ships and aircraft for use in the event of a water crash, ditching, ejection, or other event over water or in water. Those who depend on life preservers for survival require highly functional equipment. However, flotation collars prior to the present invention have generally provided only a limited number of life-saving features.

Typical prior art flotation collars have serious drawbacks in their construction and in their range of available features. For example, U.S. Pat. Nos. 1,385,581; 2,210,809; and 5,421,760 disclose flotation devices having several independent compartments, such that if one of the compartments fail, the apparatus will still support the weight of the wearer. However, in those devices, support is provided from the neck up only. This forces the wearer to bob face forward in the water in an extreme vertical position. Swimming, especially for any distance, is difficult and exhausting.

Furthermore, some prior art devices provide only unstable support if one of the air compartments fail. In this event, it may be difficult for the wearer to keep his head squarely above water. Also, with many of the prior art devices, when water surges at the user, it is channeled between the inflated lobes of the flotation device directly into the wearer's nose and mouth. Yet another problem with some prior inventions is that they are not compatible with typical military equipment including seating restraint harnesses, head gear, survival vests, and auxiliary belts due to weight and volume.

A personal flotation device should be comfortable to wear on a continuous basis, in or out of the water; be compatible with other typical survival gear; be quickly and easily put on and removed; provide immediate support through redundant inflation components; provide easy-to-use manual inflation components; provide continued and stable support should one of the flotation cells fail to operate; and provide a shape and component parts that will prevent water from surging at the user's nose and mouth.

SUMMARY OF THE INVENTION

The present invention is a personal flotation device for use by aircraft and shipboard personnel in the event of an emergency. It is in an integrated system of components that are constructed and assembled to provide the user with an extremely efficient, complete, and functional life-saving flotation collar. It includes (1) two manually or automatically inflatable, independent, and symmetric flotation cells installed within a fabric shell; (2) two oral inflators; (3) a face shield housed in the fabric shell; and (4) an exterior protective cover. The flotation collar may be used with a survival vest, or with an auxiliary belt.

Because the two flotation cells are completely independent, if one cell fails, the other can support the user with his/her head elevated, with his/her face out of the water. Because the cells are symmetric, only one cell can support the user in a relatively comfortable attitude, should the other cell fail.

Putting on and using the flotation collar is quick and simple, as shown by the following instructions:

1. The user attaches the collar front and rear fasteners to the mating front and rear fasteners of his survival vest or auxiliary belt. The user then dons the assembled system.
2. Once the user has donned the system, he fastens the collar chest strap.
3. After clearing the submerging vehicle or upon entering the water, the user pulls one or both of the beaded activation handles located on the exterior protective cover to initiate inflation. If one or both inflation cells do not inflate, the user inflates the cells via the oral inflator(s).
4. The user adjusts the front straps to the desired comfort level.
5. The user deploys the face shield by pulling either release tab located adjacent to the user's helmet. Once the shield is released from its stowage pouch, the user pulls it up and over his helmet, and secures it to the forward area of the flotation shell by hook and pile (e.g., Velcro™) fasteners. The user may discard or release the face shield respectively by:
   (a) Grasping the rear area of the shield and pulling up sharply with either or both hands, then releasing the front attachment to completely detach it from the shell, or
   (b) Releasing the front attachments only and pulling the shield back over the helmet for retention and later use.

The present invention will continue to function properly and provide stable support if one of the flotation cells fails. It orients the user's face upward in the water, and elevates his head and upper torso out of the water. It supports the user's upper torso as well as the user's head, thus making swimming easier.

The present invention is compatible with current military helmets, restraint harnesses, survival equipment, and vests. It also provides a place for the user to rest his arms.

It is compact and lightweight and thus can be worn comfortably on a continuous basis.

It can be easily removed and replaced in-flight by a seated wearer, providing mission/task flexibility.

It can be used with an auxiliary belt alone (i.e., without a survival vest) which provides the wearer with additional mobility and comfort during shipboard operations.

Accordingly, it is the object of the present invention to provide a superior means for the user to survive a water ditching or crash emergency, falling overboard, ejection, or other in-water emergency.

It is another object of the present invention to provide redundancy in inflation by interconnecting the manual inflation handles so that the user can activate both flotation cells by pulling either handle.

It is another object of the present invention to provide a flotation device that can be easily and quickly put on and taken off.

It is another object of the present invention to provide a flotation device that is compatible with typical military gear including helmets, survival vests, and auxiliary belts.

It is another object of the present invention to provide the user with stable support in the water in the event that one of the flotation cells fail.

It is another object of the present invention to provide a device that is comfortable enough to be worn continuously and remains comfortable when deployed in an emergency situation.

It is another object of the present invention to provide a flotation device that provides a component for deflecting water from the user's nose and mouth.

It is also an object of the present invention to provide a flotation device that, through its outer shape, allows free rotation of the user's neck and head.

DETAILED DESCRIPTION OF THE INVENTION

The primary components of the flotation collar are an outer protective cover, a fabric shell, two inflatable flotation cells, two oral inflators, two mechanical inflators, a harness system, an integrated face shield, and, optionally, automatic water-sensing actuators.

Figure 1C:
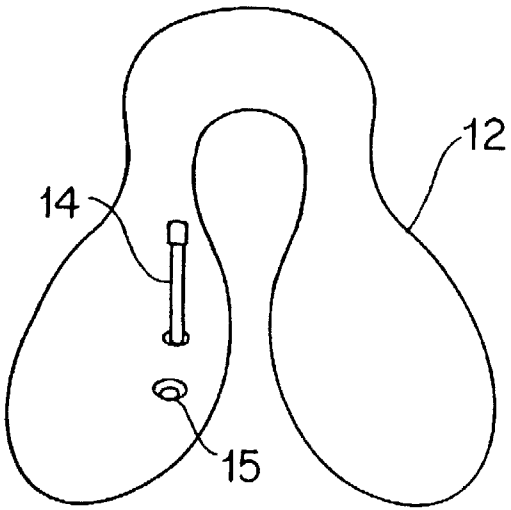
FIGS. 1*b* and 1*c* are schematic diagrams of the first and second symmetric flotation cells, respectively.
Figure 1B:
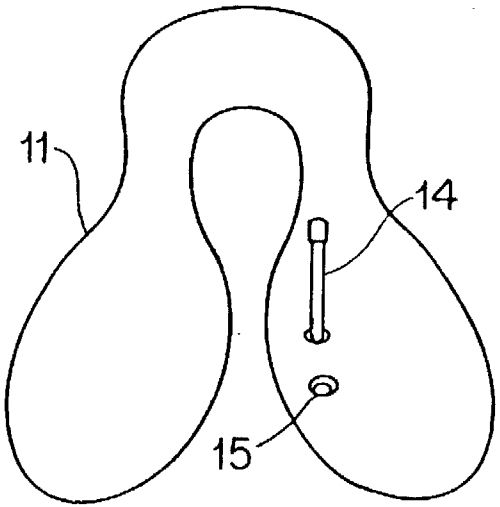
Figure 1A:
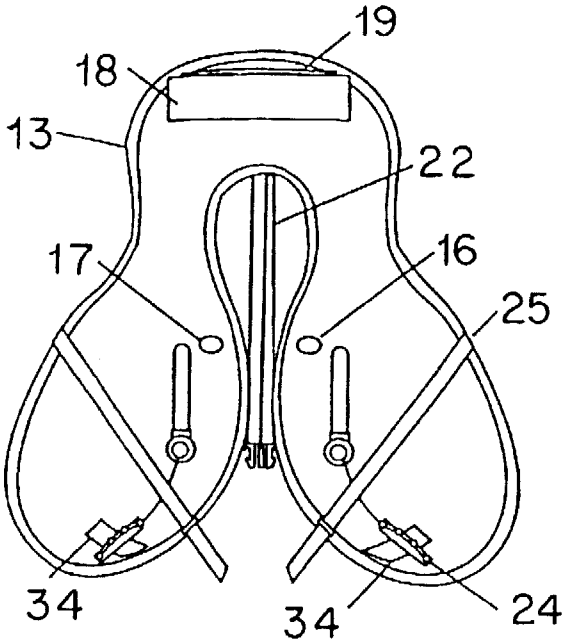
FIG. 1*a* is a schematic diagram of the fabric shell within which the symmetric flotation cells of the present invention are installed.

As shown in FIGS. 1*a*–1*d*, the present invention comprises two mechanically, automatically or orally inflated flotation cells 11 and 12, which are installed in a fabric shell 13. Flotation cells 11 and 12 are totally independent of each other, i.e., there is no fluid connection between the two cells. If one of the cells rafts, the other cell will continue to support the user. FIGS. 1*a*–1*c* also show oral inflators 14 in flotation cells 11 and 12, valve adaptor 15 which connects the flotation cells to the $CO_2$. inflation mechanism, access port 16 in fabric shell 13 for the oral inflators, $CO_2$. inflation mechanism and cylinders 17, stowage pouch 18 for the face shield, and zippered access to fabric shell 13 (for installation of flotation cells 11 and 12), rear hold-down straps 22, beaded handles 24, front hold-down straps 25, and face shield hold down tabs 34.

Figure 1D:
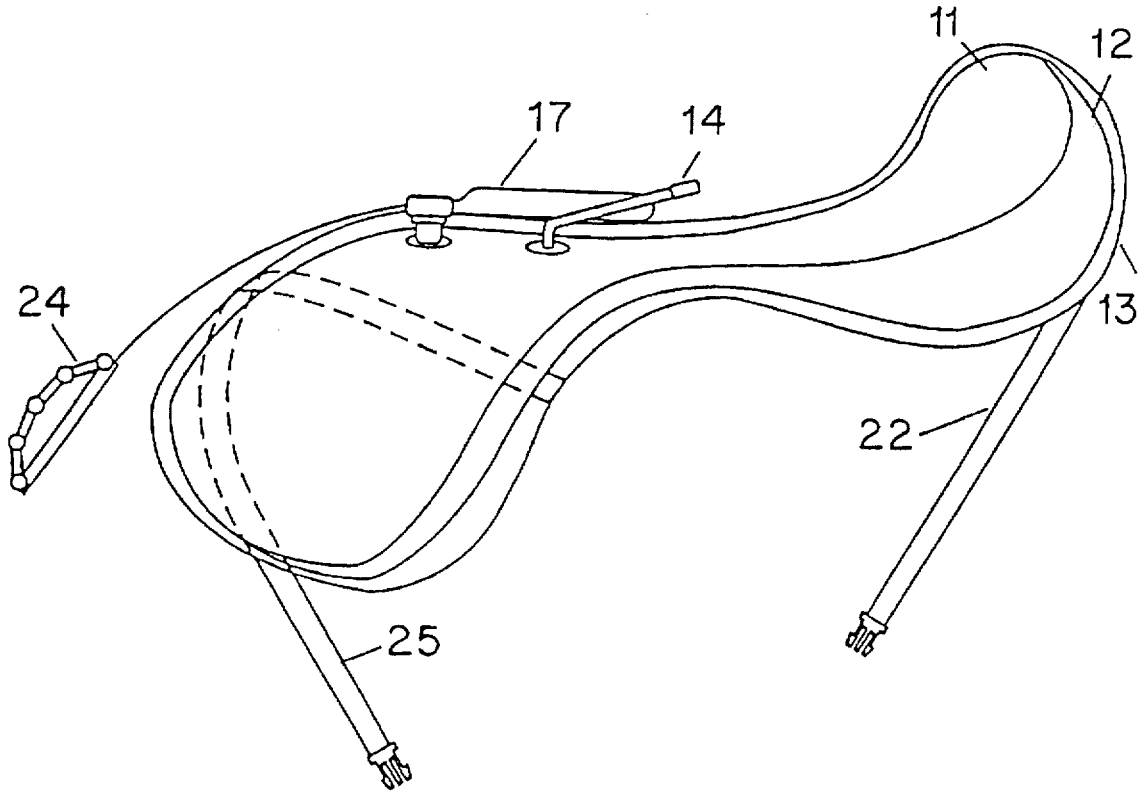
FIG. 1*d* is a schematic diagram of a side view of the first and second flotation cells in the fabric shell.
Figure 1E:
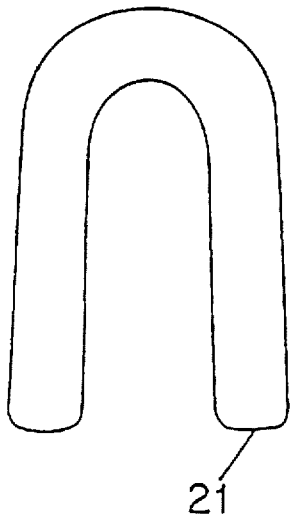
FIG. 1*e* is a schematic diagram of protective collar 21.

FIG. 1*d* is a side view showing flotation cells 11 and 12 inside fabric shell 13.

Figure 2A:
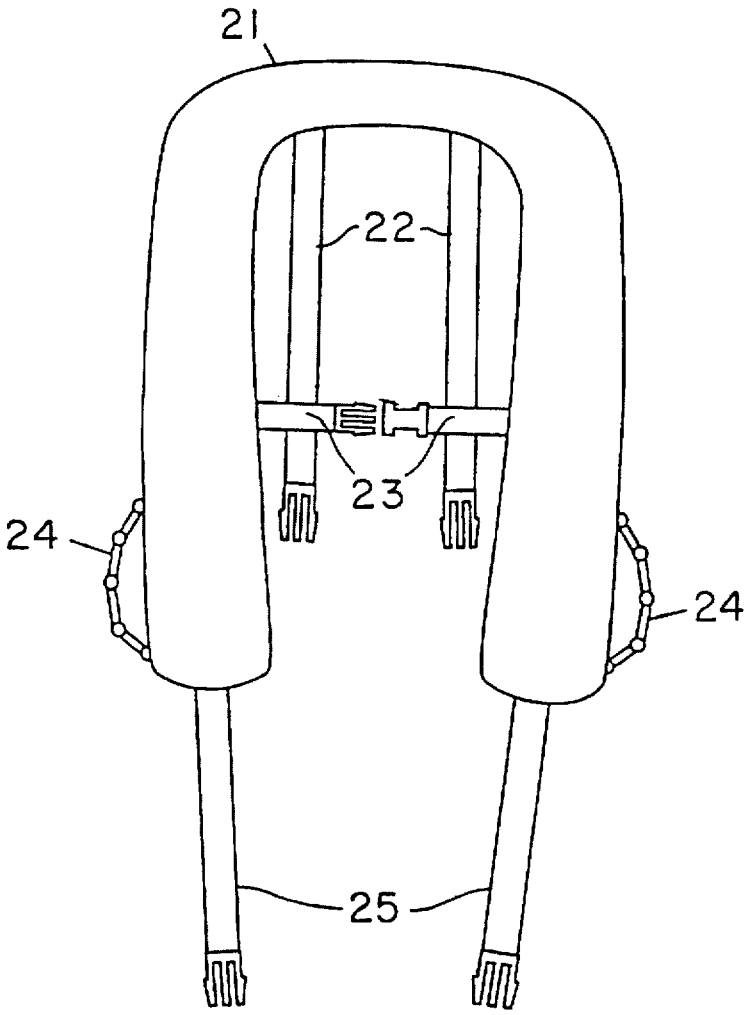
FIG. 2*a* is a schematic diagram of a frontal view of the flotation collar before deployment.

As shown in FIG. 2*a*, protective collar 21 is secured to the user by rear hold-down adjustable straps 22, chest straps 23, and front hold-down adjustable straps 25. The straps force the inflated shell to conform closely to the user's torso. This elevates the user's head further out of the water, reduces the water drag, and stabilizes the user, allowing the user to swim forward more easily. Front hold-down adjustable straps 25 extend over each side of the inflated shell and also provide a means for the user to rest his arms while awaiting rescue.

Front straps 25 secure the inflation shell within the exterior protective cover during normal use, and ensure that the inflation shell emerges from the cover in the proper sequence during inflation. Beaded handles 24 are used to activate pneumatic inflation actuators, which inflate the flotation cells by releasing gas from, e.g., carbon dioxide cylinders, mounted on the user's front left and right sides, when beaded handles 24 are pulled. In addition, the user can manually activate both flotation cells via a single beaded handle. This is an important feature, since the user may be incapacitated in either hand or arm. This manually redundant inflation activation is achieved by a "Y" bridle and lanyard arrangement that interconnects both beaded handles and pneumatic actuators.

On the back of the uninflated collar are two adjustable back straps 22, attached to the collar. These attach to the back of the user's survival vest or belt. The back straps also help control the shape of the inflated shell and elevate the head and upper torso further out of the water.

Figure 2B:
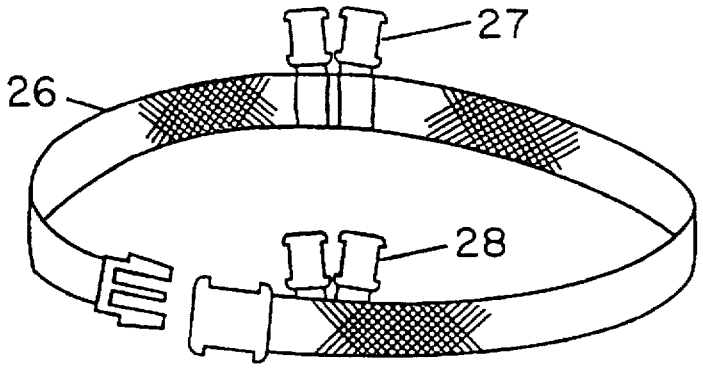
FIG. 2*b* is a schematic diagram of an auxiliary belt that can be used with the flotation collar.

FIG. 2*b* shows auxiliary belt 26, which is used when the user is not wearing a survival vest. Connectors 27 and 28 are used to securely connect back straps 22 and front straps 25, respectively, to the auxiliary belt.

Figure 2C:
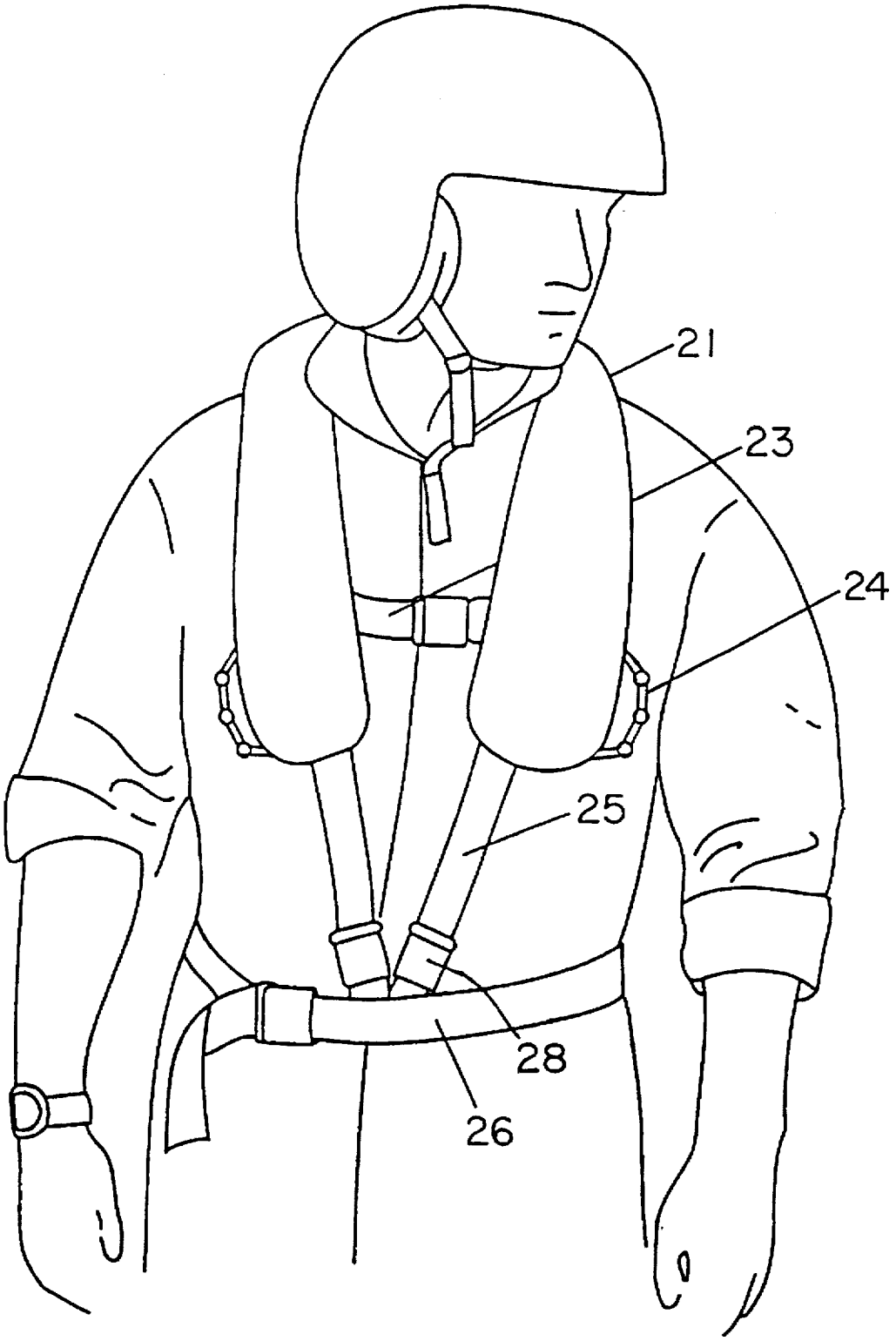
FIG. 2*c* is a schematic diagram of a frontal view of the undeployed flotation collar attached to the auxiliary belt, shown as it would be worn by the user.

FIG. 2*c* shows a user wearing the flotation collar with an auxiliary belt.

Figure 3:
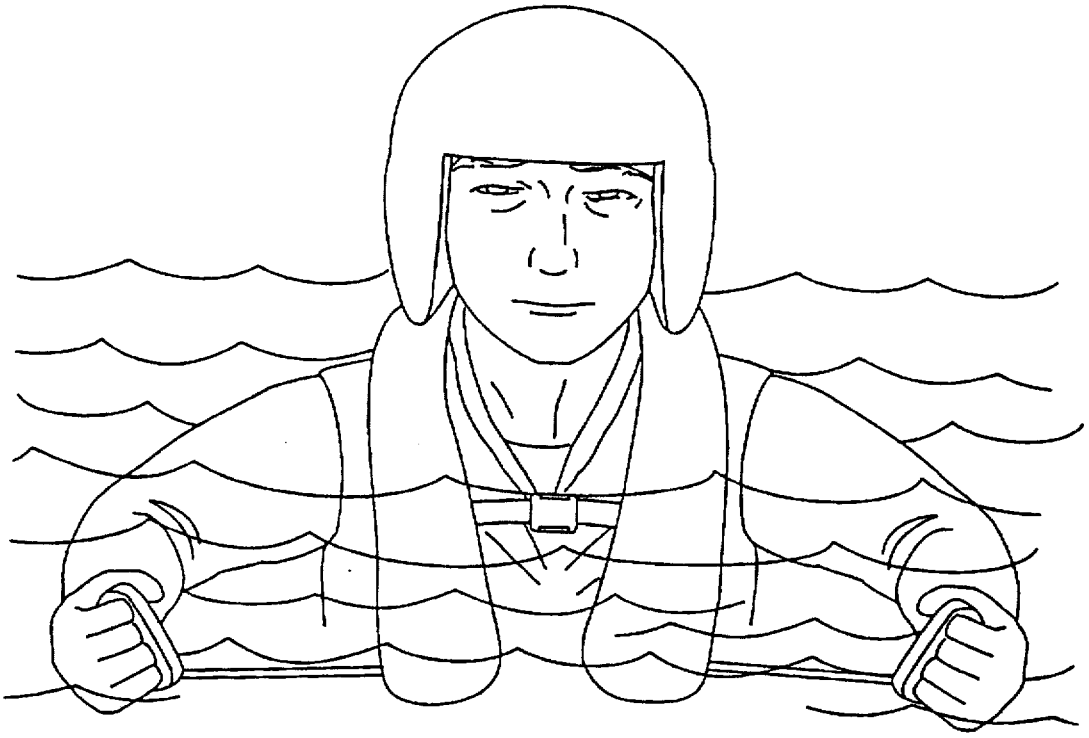
FIG. 3 is a schematic diagram of a user in water deploying the flotation collar by pulling the beaded handles.
Figure 4:
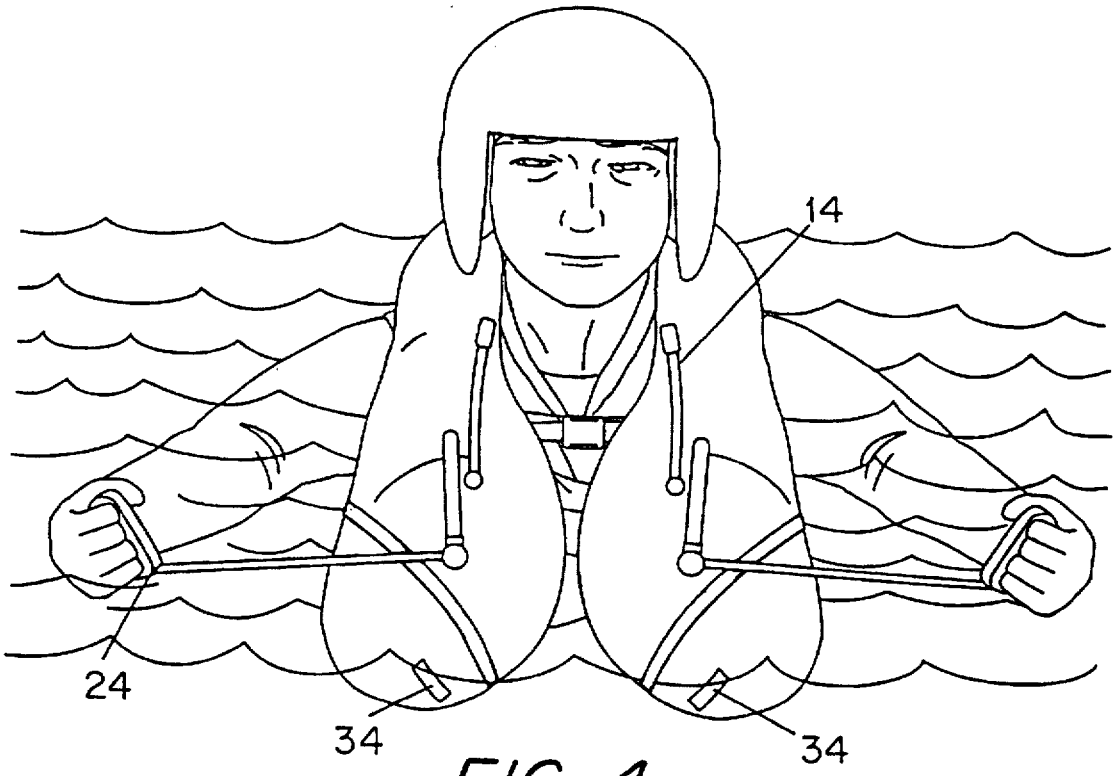
FIG. 4 is a schematic diagram of a frontal view of a user in water after deployment, with the flotation collar fully inflated.
Figure 5:
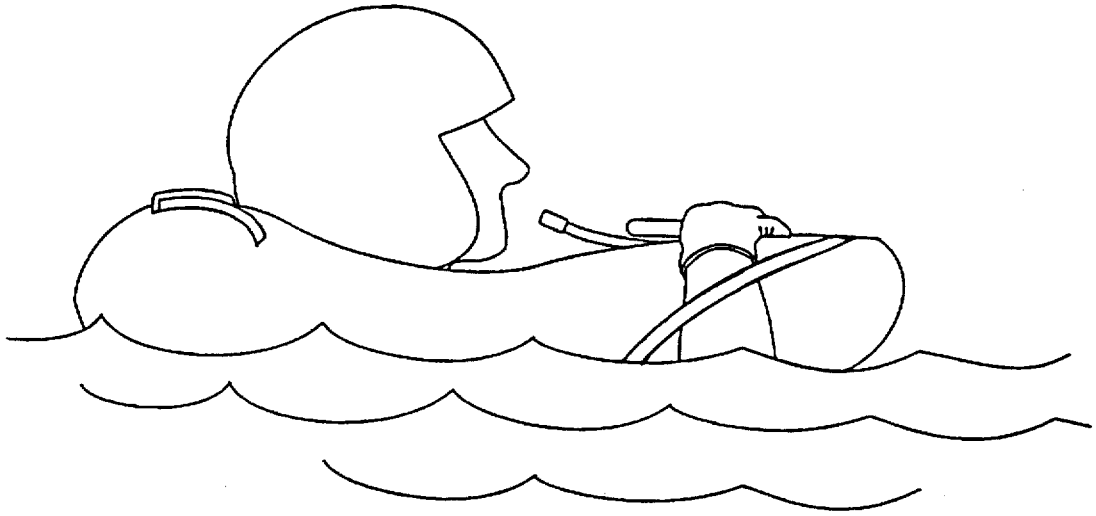
FIG. 5 is a side view of a user in water wearing the deployed flotation collar and resting his arms on the front straps.

FIGS. 3–5 demonstrate the use of the present invention. In FIG. 3, the user is pulling on the beaded handles to start inflation. In FIG. 4, the flotation collar has been fully inflated. FIG. 5 shows the user resting his arms on the front straps, with his head elevated out of the water by the flotation collar.

Figure 6:
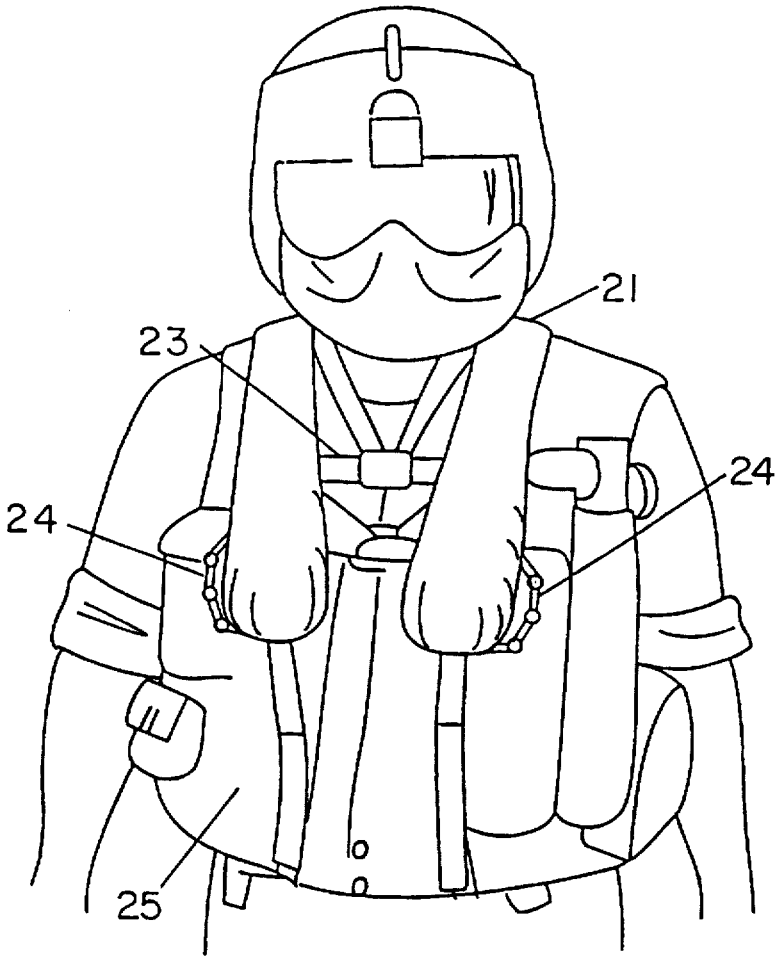
FIG. 6 is a frontal view of a user wearing an undeployed flotation collar over a survival vest.
Figure 8:
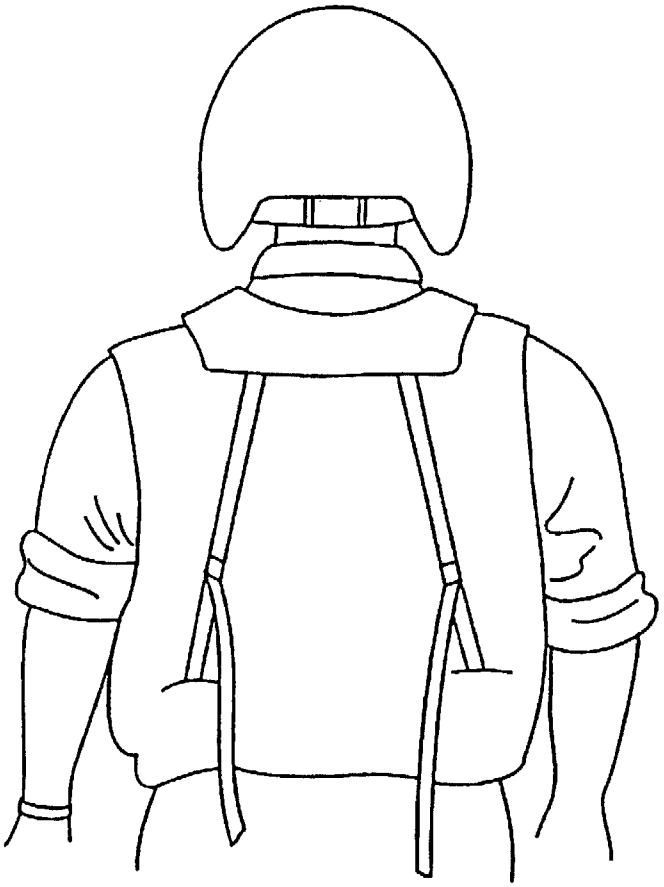
FIG. 8 is a back view of a user wearing an undeployed flotation collar over a survival vest.
Figure 7:
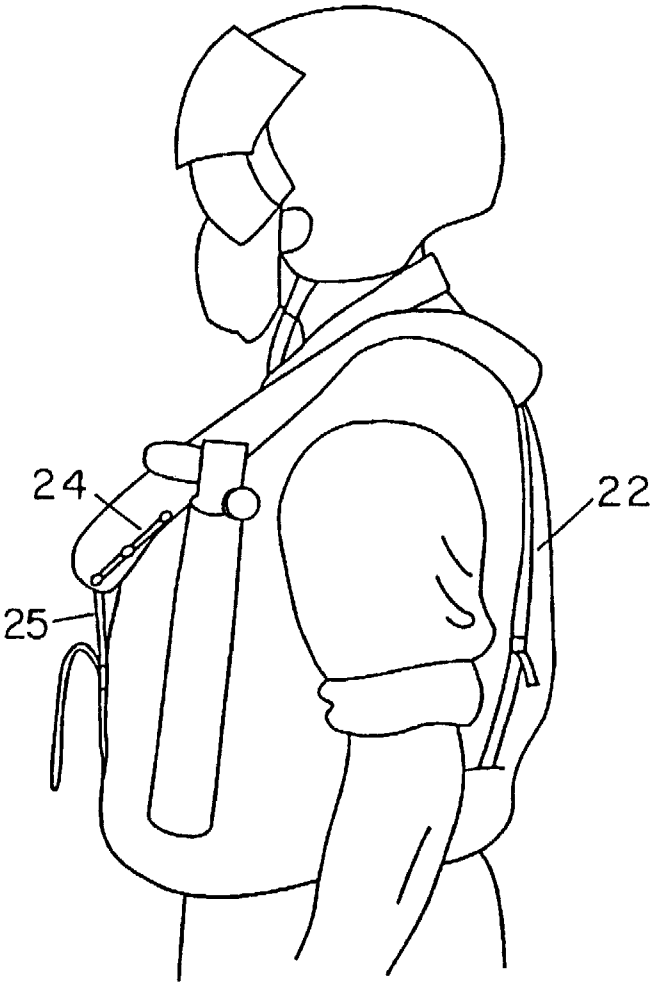
FIG. 7 is a side view of a user wearing an undeployed flotation collar over a survival vest.
Figure 9:
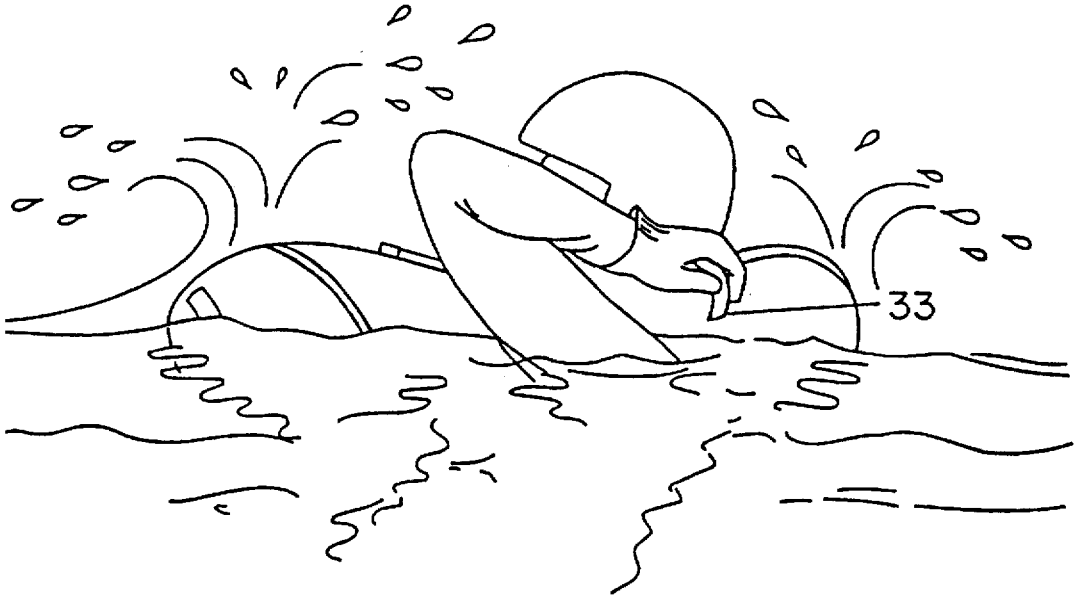
FIG. 9 is a side view of a user wearing an inflated flotation collar in water. The user is shown reaching back to begin deploying the face shield.
Figure 10:
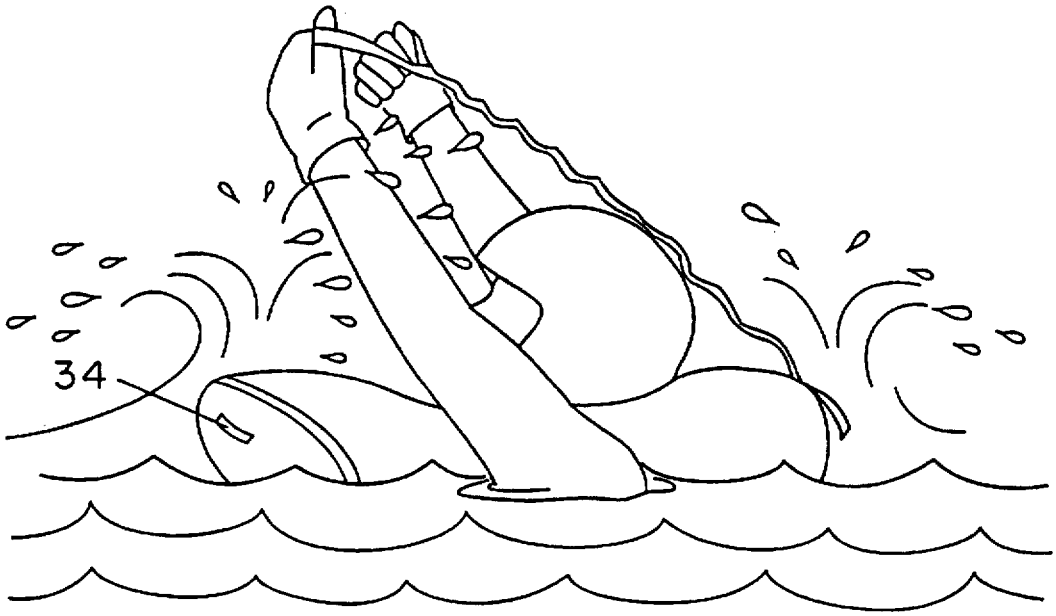
FIG. 10 is a side view of a user wearing an inflated flotation collar in water. The user is shown pulling the tabs on the face shield forward.
Figure 11:
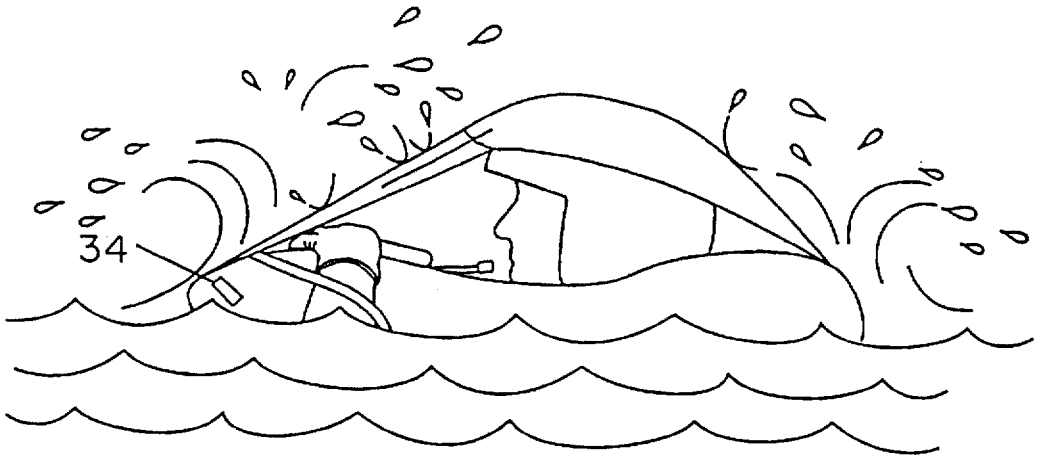
FIG. 11 is a side view of a user wearing an inflated flotation collar in water, showing the face shield fully deployed and attached to the front of the collar. The user is shown resting his arms in the front straps.

FIGS. 6 to 8 show a user wearing the present invention with a survival vest.

The individual flotation cells are constructed from symmetric patterns that permit ease of repair or interchangability. They are made of polyurethane-coated nylon. Installation into the fabric shell is accomplished via zippered access for each cell. The zippered access is located on the top surface of the fabric shell.

Once the collar is inflated, the two carbon dioxide cylinders are exposed on the front of the flotation collar. After rescue or after a standard mainteneance test, they can be discarded by unscrewing them from the actuators. Also visible are two oral inflators, one on each side of the front of the collar near the user's mouth. As can be seen from FIG. 5, the shape of the inflated shell reduces the surge of water into the user's nose and mouth.

A preferred embodiment of the present invention includes a face shield to allow the user to breathe and see in wind-driven water spray conditions. As shown in FIGS. 9–12, the user releases the face shield and pulls it over his head for protection after inflation of the flotation collar. Inflation of the shell reveals a pocket on the top of the back of the collar directly behind the user's head. This pocket, which is secured with Velcro® tabs, stores an adjustable, clear, flexible face shield 31 attached to a stretchable fabric 32. Two release tabs 33 are provided for access by either hand to deploy the face shield over the head. Once pulled over the head, the face shield is secured to tabs 34 near each of the front straps 25 on the lower portion of the inflated shell. The stretchable fabric accommodates large and small helmets.

Figure 12:
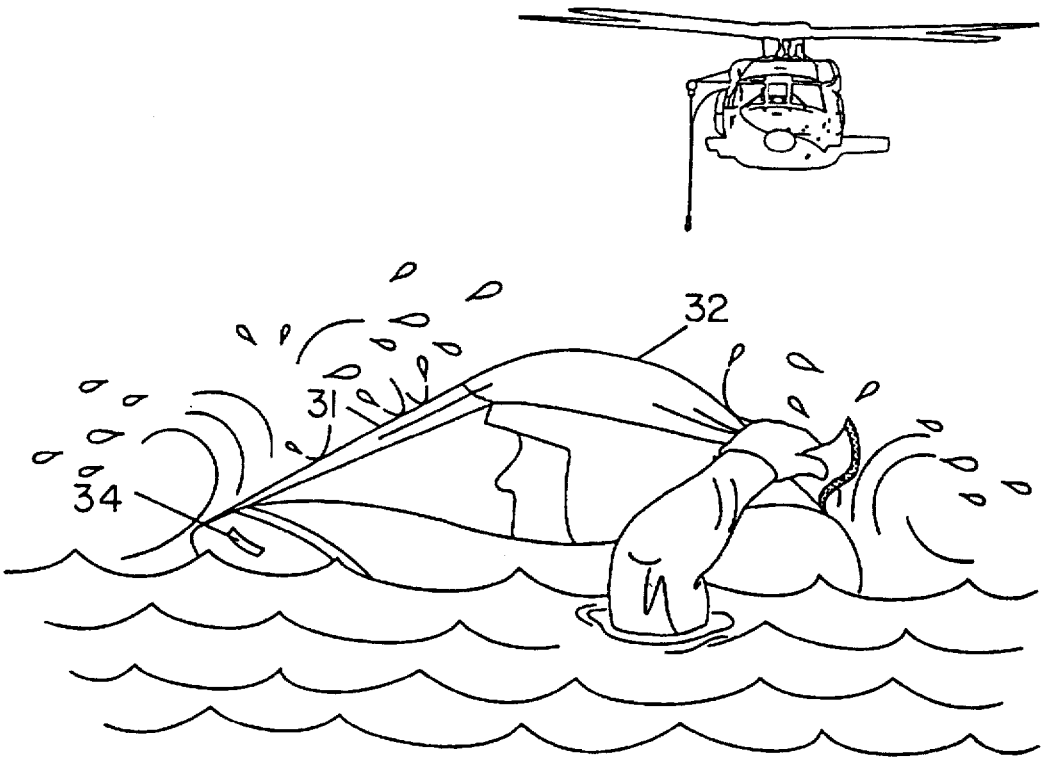
FIG. 12 is a side view of a user wearing an inflated flotation collar in water. The user is releasing the face shield to gain access to the survival vest lifting ring.

The user can detach and discard the shield at any time, as shown in FIG. 12. In FIG. 12, the user is releasing the face shield from behind the user's helmet, so that he or she can gain access to the survival vest's lifting ring (not shown).

If the user is wearing a head protection device, the shape of the inflated shell provides a contoured cradle to permit the free rotation of the user's head and neck.

Typical dimensions for the flotation collar are a length of 18 inches and a maximum width of 15 inches. The exterior protective collar is made of, e.g., an aramide fiber such as Nomex®. A releasable zipper runs the length of the outer edge of the collar and secures the fabric shell, made of nylon, within the exterior protective cover.

Automatic salt water-sensing actuators may be used with the present invention. The water sensing actuators provide the advantage of protection for the user who is unconscious, wounded, or in other ways incapable of pulling the beaded actuator handles or using the oral inflation actuators. Water sensing actuators are small electronic devices that are co-located with the $CO_2$ inflation cylinder. When salt water enters a chamber, a sensor within the actuator causes a circuit to be closed, activating the mechanism used to pierce the $CO_2$ cylinder.

The foregoing disclosure of the preferred embodiment of the invention has been presented for the purposes of illustration and description. It is not intended to be exhaustive or to limit the invention to the precise form disclosed.

Many variations and modifications of the embodiment described herein will be obvious to one of ordinary skill in the art in light of the above information. The scope of the invention is to be defined only by the claims appended hereto.

What is claimed is:

1. A flotation collar comprising:

(a) two symmetric inflatable flotation cells;

(b) means for inflating the two symmetric inflatable flotation cells;

(c) auxiliary means for orally inflating the two symmetric inflatable flotation cells;

(d) an outer shell housing the two symmetric inflatable flotation cells, said outer shell having a back-of-the-neck portion, a left front portion and a right front portion; and (e) means for securely attaching the outer shell housing to a user.

2. The flotation collar of claim 1, further comprising an integrated face shield stowed in a pocket in the back-of-the-neck portion of the outer shell.

3. The flotation collar of claim 2, wherein the integrated face shield is attached to the outer shell by a stretchable fabric.

4. The flotation collar of claim 2, wherein the integrated face shield is detachably attached to the outer shell.

5. The flotation collar of claim 2, further comprising pull tabs for releasing the integrated face shield.

6. The flotation collar of claim 1, wherein the means for inflating the flotation cells comprises pneumatic inflation actuators.

7. The flotation collar of claim 6, wherein the means for inflating the flotation cells also comprise at least one beaded handle which activates inflation of the flotation cells when pulled.

8. The flotation collar of claim 7, comprising a left beaded handle and a right beaded handle, and wherein the flotation cells can be inflated by pulling the left beaded handle alone, the right beaded handle alone, or both the left and right beaded handles.

9. The flotation collar of claim 1, wherein the means for securely attaching the outer shell housing to the user comprises rear adjustable straps, front adjustable straps, and a chest strap.

10. The flotation collar of claim 9, wherein when the flotation cells are inflated, the rear adjustable straps, the front adjustable straps and the chest strap force the inflated collar to conform closely to the user.

11. The flotation collar of claim 9, further comprising an auxiliary belt, and means for attaching the front adjustable straps and the rear adjustable straps to the auxiliary belt.

12. The flotation collar of claim 1, wherein the flotation cells are fabricated from polyurethane-coated nylon.

13. The flotation collar of claim 1, wherein the auxiliary means for orally inflating the two symmetric flotation cells are positioned in close proximity to the user's mouth.

14. The flotation collar of claim 1, wherein the exterior protective cover is fabricated from aramide fibers.

15. The flotation collar of claim 1, further comprising salt water sensing actuators.

16. A flotation safety system comprising:

(a) a survival vest;

(b) a flotation collar comprising:

(i) two symmetric inflatable flotation cells;

(ii) means for inflating the two symmetric inflatable flotation cells;

(iii) auxiliary means for orally inflating the two symmetric inflatable flotation cells;

(iv) an outer shell housing the two symmetric inflatable flotation cells, said outer shell having a back-of-the-neck portion, a left front portion and a right front portion; and (v) a protective cover housing the fabric shell; and (c) means for attaching the flotation collar to the survival vest.

17. The flotation safety system of claim 16, further comprising an integrated face shield stowed in a pocket in the back-of-the-neck portion of the outer shell.

18. The flotation collar of claim 16, wherein the means for inflating the flotation cells comprises pneumatic inflation actuators.

19. The flotation collar of claim 16, wherein the flotation cells are fabricated from polyurethane-coated nylon.

20. The flotation collar of claim 16, wherein the exterior protective cover is fabricated from aramide fibers.

21. A flotation collar comprising:

(a) a first symmetric inflatable flotation cell;

(b) a second symmetric inflatable flotation cell having no fluid connection with the first symmetric inflatable flotation cell;

(b) auxiliary means for orally inflating the first and second symmetric inflatable flotation cells;

(c) an outer shell housing the first and second symmetric inflatable flotation cells, said outer shell having a back-of-the-neck portion, a left front portion and a right front portion; and (d) means for securely attaching the outer shell housing to a user, wherein the first inflatable symmetric flotation cell can support the user's head above water level, and wherein the second inflatable symmetric flotation cell can support the user's head above water level.

22. The flotation collar of claim 21, further comprising an integrated face shield stowed in a pocket in the back-of-the-neck portion of the outer shell.

23. The flotation collar of claim 22, wherein the integrated face shield is attached to the outer shell by a stretchable fabric.

24. The flotation collar of claim 22, wherein the integrated face shield is detachably attached to the outer shell, and further comprises pull rings for releasing the integrated face shield.

25. The flotation collar of claim 21, further comprising pneumatic inflation actuators for inflating the first and second inflatable flotation cells.

26. The flotation collar of claim 25, further comprising at least one beaded handle which activates pneumatic inflation of the first and second symmetric flotation cells when pulled.

27. The flotation collar of claim 26, comprising a left beaded handle and a right beaded handle, and wherein the first and second flotation cells can be inflated by pulling the left beaded handle alone, the right beaded handle alone, or both the left and right beaded handles.

28. The flotation collar of claim 21, wherein the flotation cells are fabricated from polyurethane-coated nylon.

29. The flotation collar of claim 21, wherein the exterior protective cover is fabricated from aramide fibers.

30. The flotation collar of claim 21, further comprising water actuators.

31. A flotation collar comprising:

(a) a first symmetric flotation cell;

(b) a second symmetric flotation cell fluidly independent of the first symmetric flotation cell;

(c) a fabric shell housing the first and second symmetric flotation cells;

(d) means for orally and mechanically inflating the first and second symmetric flotation cells; and (e) means for securing the fabric shell to the body of a user, wherein, when a user is in the water supported by the first and second symmetric shells which are fully inflated, the inflated shells are shaped so as to reduce any surge of water towards the user's nose and mouth.

32. The flotation collar of claim 31, wherein the shape of the inflated shell conforms to the body of the user.

33. The flotation collar of claim 31, wherein the means for mechanically inflating the first and second symmetric flotation cells comprises at least one gas cylinder, wherein the carbon dioxide cylinders are mounted such that they can be easily discarded after inflation of the first and second symmetric flotation cells.

34. The flotation collar of claim 31, further comprising a face shield stowed in a pouch in the fabric shell and attached to a stretchable fabric.

35. The flotation collar of claim 34, wherein the face shield is detachable and discardable.

36. The flotation collar of claim 34, further comprising tabs on the fabric shell for securing the face shield in position over the user's face.

37. The flotation collar of claim 31, wherein the means for inflating the first and second symmetric flotation cells is redundant, such that the user can manually activate the inflation means using either hand.

38. The flotation collar of claim 31, wherein the means for inflating the first and second symmetric flotation cells comprises a water-sensing actuator.

* * * * *